US010641263B2

(12) United States Patent
Kusumba et al.

(10) Patent No.: US 10,641,263 B2
(45) Date of Patent: May 5, 2020

(54) METHOD FOR OPERATING A LINEAR COMPRESSOR

(71) Applicants: Haier US Appliance Solutions, Inc., Wilmington, DE (US); University of Louisville Research Foundation, Inc., Louisville, KY (US)

(72) Inventors: Srujan Kusumba, Louisville, KY (US); Gregory William Hahn, Louisville, KY (US); Michael Lee McIntyre, Louisville, KY (US); Joseph W. Latham, Louisville, KY (US)

(73) Assignees: Haier US Appliance Solutions, Inc., Wilmington, DE (US); University of Louisville Research Foundation, Inc., Louisville, KY (US)

( * ) Notice: Subject to any disclaimer, the term of this patent is extended or adjusted under 35 U.S.C. 154(b) by 316 days.

(21) Appl. No.: 15/691,862

(22) Filed: Aug. 31, 2017

(65) Prior Publication Data

US 2019/0063425 A1 Feb. 28, 2019

(51) Int. Cl.
*F04B 49/06* (2006.01)
*F04B 49/10* (2006.01)
(Continued)

(52) U.S. Cl.
CPC ..... *F04B 49/06* (2013.01); *F04B 35/045* (2013.01); *F04B 49/065* (2013.01); *F04B 49/10* (2013.01);
(Continued)

(58) Field of Classification Search
CPC ..... F04B 35/045; F04B 49/06; F04B 49/065; F04B 49/10; F04B 49/12;
(Continued)

(56) References Cited

U.S. PATENT DOCUMENTS 3,782,859 A 1/1974 Schuman
4,291,258 A 9/1981 Clark et al.
(Continued)

FOREIGN PATENT DOCUMENTS

EP 0620367 4/1993
EP 2686554 A2 1/2014
(Continued)

OTHER PUBLICATIONS

Beck, Wesley, Pump Handbook (2007) McGraw-Hill, 4th Edition, Chapter 16 Pump Testing (Year: 2007), pp. 16.1-16.42.
(Continued)

*Primary Examiner* — Philip E Stimpert
(74) *Attorney, Agent, or Firm* — Dority & Manning, P.A.

(57) ABSTRACT

A method for operating a linear compressor includes substituting a first observed velocity, a bounded integral of the first observed velocity, an estimated clearance, an estimated discharge pressure, and an estimated suction pressure into the mechanical dynamic model for the motor, calculating an observed acceleration for the piston with the mechanical dynamic model for the motor, calculating a second observed velocity for the piston by integrating the observed acceleration for the piston, calculating an observed position of the piston by integrating the second observed velocity for the piston, and updating an estimated clearance, an estimated discharge pressure, and an estimated suction pressure based upon an error between the first and second observed velocities and an error between the bounded integral of the first observed velocity and the observed position.

16 Claims, 9 Drawing Sheets

(51) Int. Cl.
*F04B 35/04* (2006.01)
*F25B 49/02* (2006.01)
*F25B 1/02* (2006.01)

(52) U.S. Cl.
CPC ..... *F25B 49/02* (2013.01); *F04B 2201/0202* (2013.01); *F04B 2201/0203* (2013.01); *F04B 2201/0206* (2013.01); *F04B 2203/0411* (2013.01); *F04B 2205/01* (2013.01); *F04B 2205/05* (2013.01); *F25B 1/02* (2013.01); *F25B 49/022* (2013.01); *F25B 2400/073* (2013.01); *F25B 2500/19* (2013.01)

(58) Field of Classification Search
CPC ..... F04B 2201/0201; F04B 2203/0401; F04B 2203/0402; F04B 2203/0409; F04B 2203/0411; H02P 6/006; F25B 1/02; F25B 24/073; F25B 2500/019
USPC ..... 318/127, 128, 135, 432, 434
See application file for complete search history.

(56) References Cited

U.S. PATENT DOCUMENTS 4,353,220 A 10/1982 Curwen et al.
4,538,964 A 9/1985 Brown
5,146,124 A 9/1992 Higham et al.
5,342,176 A 8/1994 Redlich
5,381,092 A 1/1995 Freedman
5,496,153 A 3/1996 Redlich
5,525,845 A 6/1996 Beale et al.
5,598,076 A 1/1997 Neubauer et al.
5,818,131 A 10/1998 Zhang
5,944,302 A 8/1999 Loc et al.
5,980,211 A 11/1999 Tojo et al.
6,231,310 B1 5/2001 Tojo et al.
6,247,900 B1 6/2001 Archibald et al.
6,289,680 B1 9/2001 Oh et al.
6,753,665 B2 6/2004 Ueda et al.
6,811,380 B2 11/2004 Kim
6,812,597 B2 11/2004 McGill et al.
6,883,333 B2 4/2005 Shearer et al.
6,946,754 B2 9/2005 Inagaki et al.
6,960,893 B2 11/2005 Yoshida et al.
7,020,595 B1 3/2006 Adibhatla et al.
7,025,571 B2 * 4/2006 Jeun ..... F04B 49/065 318/400.08
7,187,152 B1 3/2007 Tsai
7,439,692 B2 10/2008 Lee
7,453,229 B2 11/2008 Lee et al.
7,456,592 B2 11/2008 Yoo et al.
7,497,146 B2 3/2009 Clausin
7,550,941 B2 6/2009 Dainez et al.
7,614,856 B2 11/2009 Inagaki et al.
7,618,243 B2 11/2009 Tian et al.
7,628,591 B2 12/2009 Yoo et al.
7,663,275 B2 2/2010 McGill
8,011,183 B2 9/2011 Berchowitz
8,127,560 B2 3/2012 Dicken et al.
8,177,523 B2 5/2012 Patel et al.
8,241,015 B2 8/2012 Lillie et al.
8,749,112 B2 6/2014 Buquet et al.
8,784,069 B2 7/2014 Lilie et al.
9,470,223 B2 10/2016 Mallampalli et al.
9,518,578 B2 12/2016 Dainez et al.
9,890,778 B2 2/2018 Kusumba et al.
9,970,426 B2 5/2018 Kim et al.
2001/0005320 A1 6/2001 Ueda et al.
2002/0093327 A1 7/2002 Yoo et al.
2002/0150477 A1 10/2002 Hwang et al.
2003/0026703 A1 2/2003 Yoo et al.
2003/0044286 A1 3/2003 Kim
2003/0099550 A1 5/2003 Kim
2003/0108430 A1 6/2003 Yoshida et al.
2003/0147759 A1 8/2003 Chang
2003/0161734 A1 8/2003 Kim
2003/0177773 A1 9/2003 Kim
2003/0201745 A1 10/2003 Hayashi
2004/0005222 A1 1/2004 Yoshida et al.
2004/0066163 A1 4/2004 Yoo et al.
2004/0067140 A1 4/2004 Yoo et al.
2004/0071556 A1 4/2004 Sung et al.
2004/0108824 A1 6/2004 Ueda et al.
2004/0119434 A1 6/2004 Dadd
2004/0169480 A1 9/2004 Ueda et al.
2004/0189103 A1 9/2004 Duncan et al.
2004/0236494 A1 11/2004 DeBotton et al.
2005/0031470 A1 2/2005 Lee
2005/0083196 A1 4/2005 Furem et al.
2005/0111987 A1 5/2005 Yoo et al.
2005/0137722 A1 6/2005 Yoo et al.
2005/0141998 A1 6/2005 Yoo et al.
2005/0168179 A1 8/2005 McGill et al.
2006/0070518 A1 4/2006 McGill et al.
2006/0110259 A1 5/2006 Puff et al.
2006/0171814 A1 8/2006 Dainez et al.
2006/0171822 A1 8/2006 Seagar et al.
2006/0228221 A1 10/2006 Heo
2006/0228224 A1 10/2006 Hong et al.
2006/0251524 A1 11/2006 Yoo et al.
2006/0257264 A1 11/2006 Kim et al.
2007/0095073 A1 5/2007 Tian et al.
2007/0159128 A1 7/2007 Dainez et al.
2007/0196214 A1 8/2007 Bocchiola
2007/0241697 A1 10/2007 Sung et al.
2007/0241698 A1 10/2007 Sung et al.
2007/0276544 A1 11/2007 Dainez et al.
2008/0294098 A1 11/2008 Sarkinen et al.
2009/0004026 A1 1/2009 Yoo et al.
2009/0010766 A1 1/2009 Yoo et al.
2009/0039655 A1 2/2009 Berchowitz
2009/0047138 A1 2/2009 Yoo et al.
2009/0094977 A1 4/2009 Hill
2009/0097987 A1 4/2009 Sung et al.
2009/0263262 A1 10/2009 McGill
2010/0047079 A1 2/2010 Reinschke
2011/0056196 A1 3/2011 Berchowitz et al.
2011/0056235 A1 3/2011 Hoshino et al.
2011/0058960 A1 3/2011 Lilie et al.
2011/0103973 A1 5/2011 Dainez et al.
2012/0177513 A1 7/2012 Lilie et al.
2012/0257993 A1 10/2012 Ono et al.
2013/0034456 A1 2/2013 Schoegler
2013/0189119 A1 7/2013 Dainez et al.
2013/0243607 A1 9/2013 Dainez et al.
2014/0072461 A1 3/2014 Barito et al.
2014/0186194 A1 7/2014 Dainez et al.
2014/0234137 A1 8/2014 Roman et al.
2014/0333236 A1 11/2014 Yamanaka et al.
2015/0125323 A1 5/2015 Stair et al.
2015/0226195 A1 8/2015 Mallampalli et al.
2016/0215767 A1 7/2016 Kusumba et al.
2016/0215770 A1 7/2016 Kusumba et al.
2016/0215772 A1 7/2016 Kusumba et al.
2016/0305420 A1 10/2016 Adler et al.
2017/0009762 A1 1/2017 Lilie et al.
2017/0122305 A1 5/2017 Kusumba et al.
2017/0122309 A1 * 5/2017 Kusumba ..... F04B 51/00

FOREIGN PATENT DOCUMENTS

JP H09287558 11/1997
JP 2003315205 A 11/2003
JP 3762469 B2 4/2006
WO WO 0079671 A1 12/2000
WO WO 2005/028841 3/2005
WO WO 2006/013377 2/2006

(56) References Cited

FOREIGN PATENT DOCUMENTS

| | | |
|---|---|---|
| WO | WO 2006/081642 | 8/2006 |
| WO | WO 2013/003923 | 1/2013 |

OTHER PUBLICATIONS

Bidikli et al., A New Robust 'Integral of Sign of Error' Feedback Controller with Adaptive Compensation Gain, 52nd IEEE Conference on Decision and Control, Dec. 10-13, 2013, Florence, Italy, pp. 3782-3787.

Chen et al., Accurate Motion Control of Linear Motors with Adaptive Robust Compensation of Nonlinear Electromagnetic Field Effect, (Proceedings of the ASME 2011 Dynamic Systems and Control Conference, DSCC 2011, Oct. 31-Nov. 2, 2011, Arlington, VA, USA, DSCC2011-5991), 8 pages.

Chiang et al., Innovative Linear Compressor by Magnetic Drive and Control, (Proceedings of 2011 International Conference on Modelling, Identification and Control, Shanghai, China, Jun. 26-29, 2011), pp. 300-305.

Mantri et al., Development and Validation of Integrated Design Framework for Compressor System Model, Purdue University / Purdue e-Pubs, International Compressor Engineering Conference, School of Mechanical Engineering, 2014 (10 pages).

Mehta et al., Principles of Electrical Engineering and Electronics, Jan. 1, 2006, S. Chand & Company Ltd., 2nd Ed., pp. 275-277.

Smith, The Scientist and Engineer's Guide to Digital Signal Processing, Second Edition, published 1999, 22 pages.

Xian et al., A Continuous Asymptotic Tracking Control Strategy for Uncertain Nonlinear Systems, IEEE Transactions on Automatic Control, vol. 49, No. 7, Jul. 2004, pp. 1206-1211.

* cited by examiner

METHOD FOR OPERATING A LINEAR COMPRESSOR

FIELD OF THE INVENTION

The present subject matter relates generally to linear compressors, such as linear compressors for refrigerator appliances.

BACKGROUND OF THE INVENTION

Certain refrigerator appliances include sealed systems for cooling chilled chambers of the refrigerator appliances. The sealed systems generally include a compressor that generates compressed refrigerant during operation of the sealed systems. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. A voltage excitation induces a current within the driving coil that generates a force for sliding the piston forward and backward within a chamber. During motion of the piston within the chamber, the piston compresses refrigerant. Motion of the piston within the chamber is generally controlled such that the piston does not crash against another fixed component of the linear compressor during motion of the piston within the chamber. Such hard head crashing can damage various components of the linear compressor, such as the piston or an associated cylinder. While hard head crashing is preferably avoided, it can be difficult to accurately control a motor of the linear compressor to avoid hard head crashing. In addition, it can be difficult to accurately determine suction pressure and/or a discharge pressure of the linear compressor without costly pressure sensors.

Accordingly, a method for operating a linear compressor with features for determining a piston clearance without utilizing a position sensor would be useful. In addition, a method for operating a linear compressor with features for accurately determining a suction pressure and/or a discharge pressure of the linear compressor without costly pressure sensors would be useful.

BRIEF DESCRIPTION OF THE INVENTION

The present subject matter provides a method for operating a linear compressor. The method includes substituting a first observed velocity, a bounded integral of the first observed velocity, an estimated clearance, an estimated discharge pressure, and an estimated suction pressure into the mechanical dynamic model for the motor, calculating an observed acceleration for the piston with the mechanical dynamic model for the motor, calculating a second observed velocity for the piston by integrating the observed acceleration for the piston, calculating an observed position of the piston by integrating the second observed velocity for the piston, and updating an estimated clearance, an estimated discharge pressure, and an estimated suction pressure based upon an error between the first and second observed velocities and an error between the bounded integral of the first observed velocity and the observed position. Additional aspects and advantages of the invention will be set forth in part in the following description, or may be apparent from the description, or may be learned through practice of the invention.

In a first example embodiment, a method for operating a linear compressor is provided. The method includes calculating a first observed velocity for a piston of the linear compressor using at least an electrical dynamic model for a motor of the linear compressor and a robust integral of the sign of the error feedback, calculating a bounded integral of the first observed velocity, substituting the first observed velocity and the bounded integral into a mechanical dynamic model for the motor, estimating a clearance of the piston, a discharge pressure of the linear compressor and a suction pressure of the linear compressor, substituting the estimated clearance, the estimated discharge pressure, and the estimated suction pressure into the mechanical dynamic model for the motor, calculating an observed acceleration for the piston with the mechanical dynamic model for the motor, calculating a second observed velocity for the piston by integrating the observed acceleration for the piston, calculating an observed position of the piston by integrating the second observed velocity for the piston, determining an error between the first and second observed velocities and an error between the bounded integral of the first observed velocity and the observed position, and updating the estimated clearance, the estimated discharge pressure, and the estimated suction pressure based upon the error between the first and second observed velocities and the error between the bounded integral of the first observed velocity and the observed position.

In a second example embodiment, a method for operating a linear compressor is provided. The method includes a step for calculating a first observed velocity for a piston of the linear compressor using at least an electrical dynamic model for a motor of the linear compressor and a robust integral of the sign of the error feedback. The method also includes substituting the first observed velocity, a bounded integral of the first observed velocity, an estimated clearance, an estimated discharge pressure, and an estimated suction pressure into the mechanical dynamic model for the motor. The method further includes a step for calculating an observed acceleration for the piston with the mechanical dynamic model for the motor. The method additionally includes calculating a second observed velocity for the piston by integrating the observed acceleration for the piston, calculating an observed position of the piston by integrating the second observed velocity for the piston, determining an error between the first and second observed velocities and an error between the bounded integral of the first observed velocity and the observed position, and updating the estimated clearance, the estimated discharge pressure, and the estimated suction pressure based upon the error between the first and second observed velocities and the error between the bounded integral of the first observed velocity and the observed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
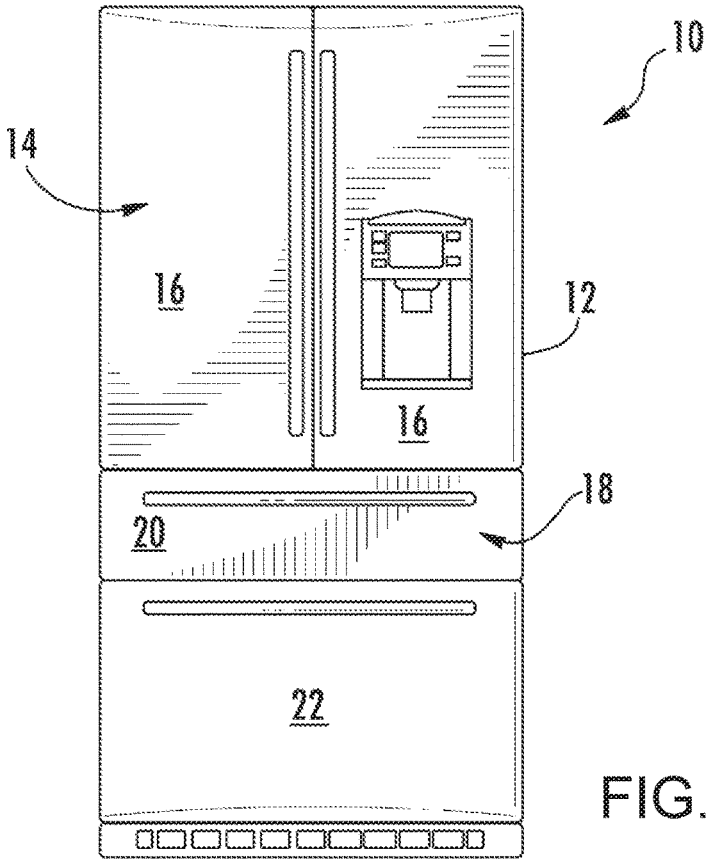
FIG. 1 is a front elevation view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
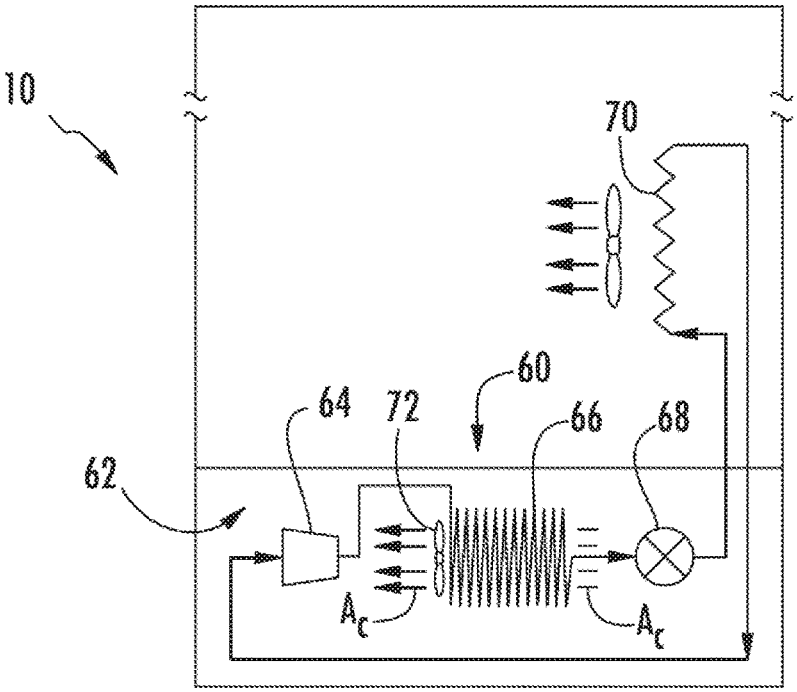
FIG. 2 is schematic view of certain components of the example refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated example embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
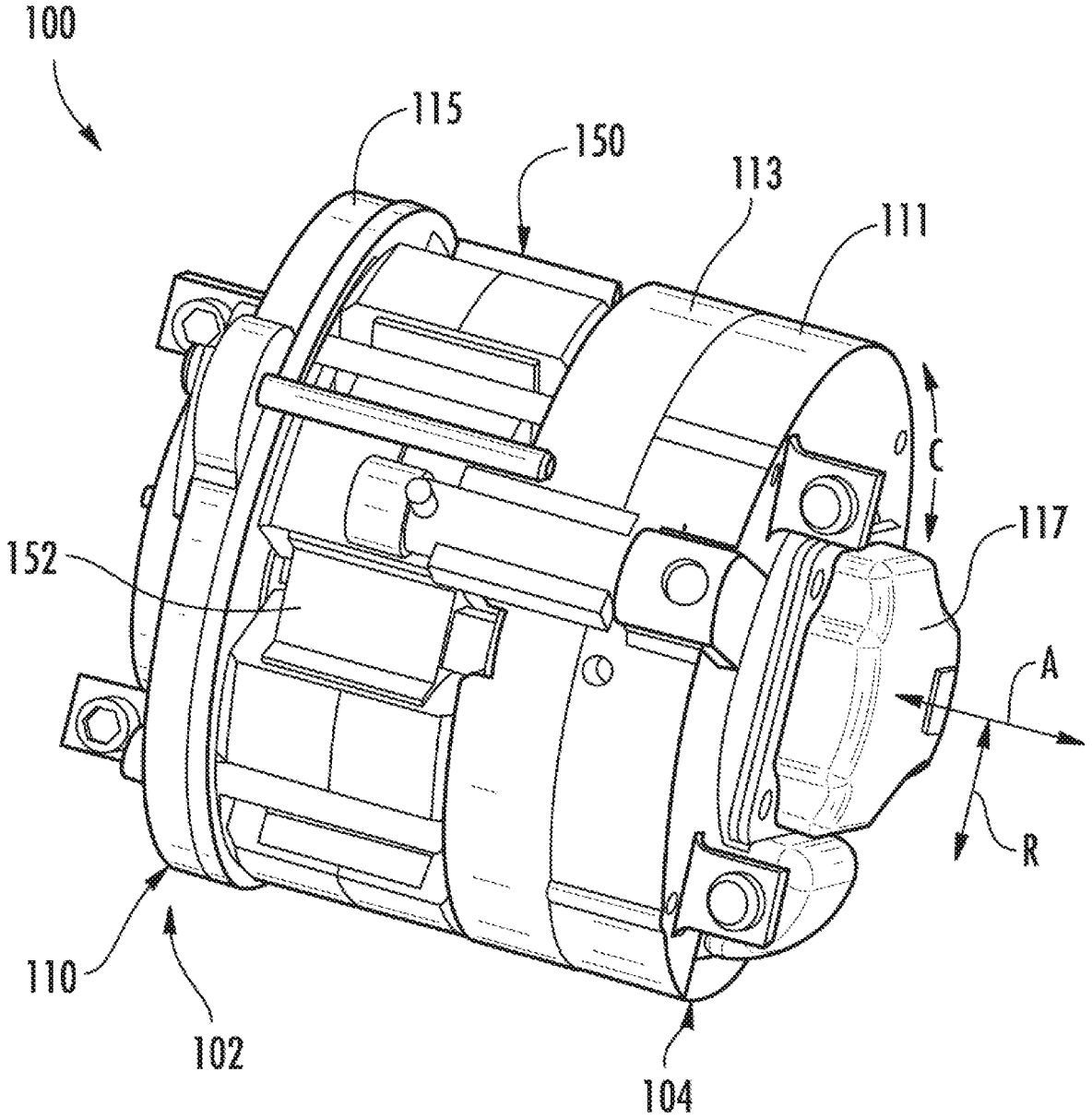
FIG. 3 is a perspective view of a linear compressor according to an example embodiment of the present subject matter.
Figure 4:
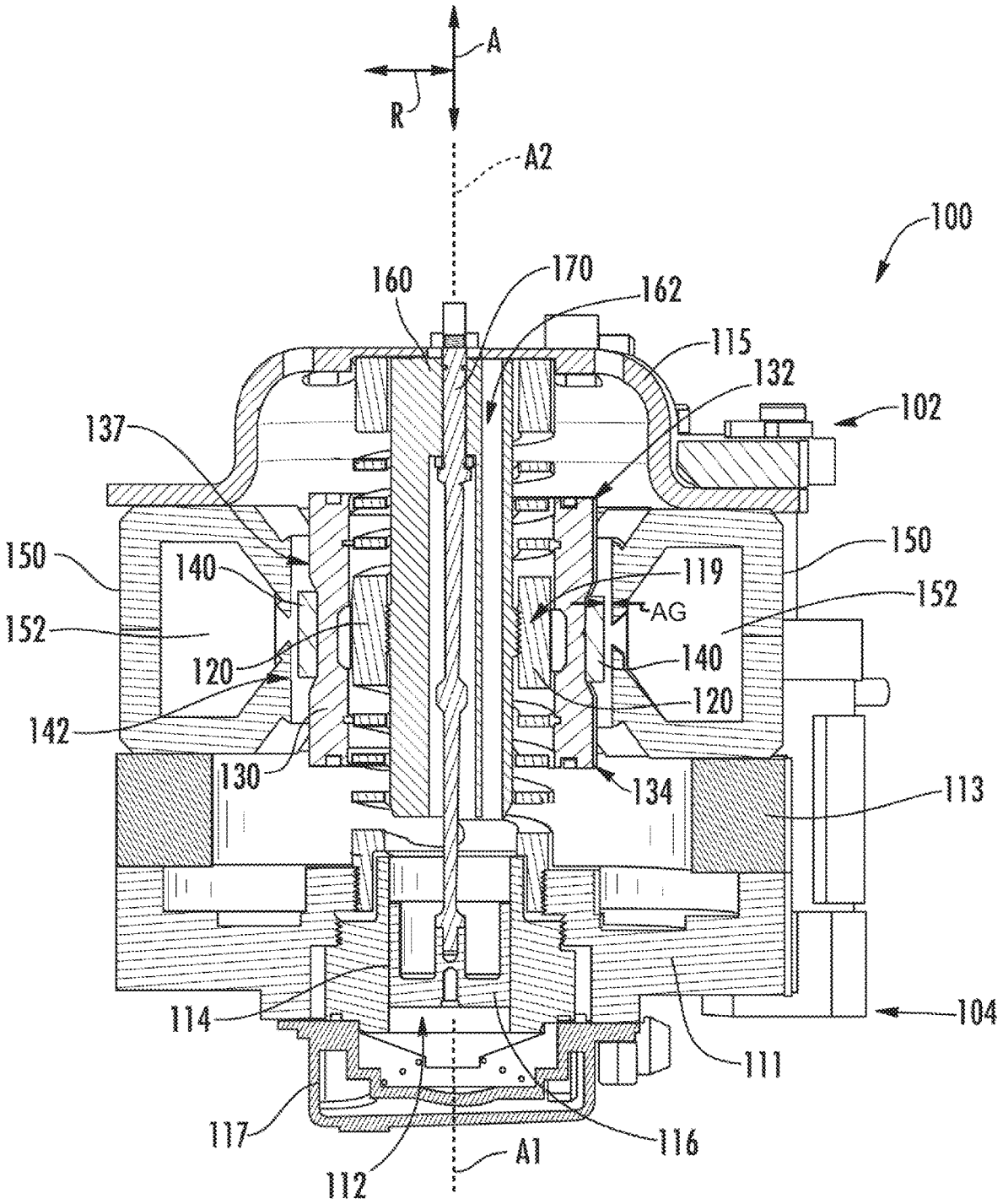
FIG. 4 is a side section view of the example linear compressor of FIG. 3.
Figure 5:
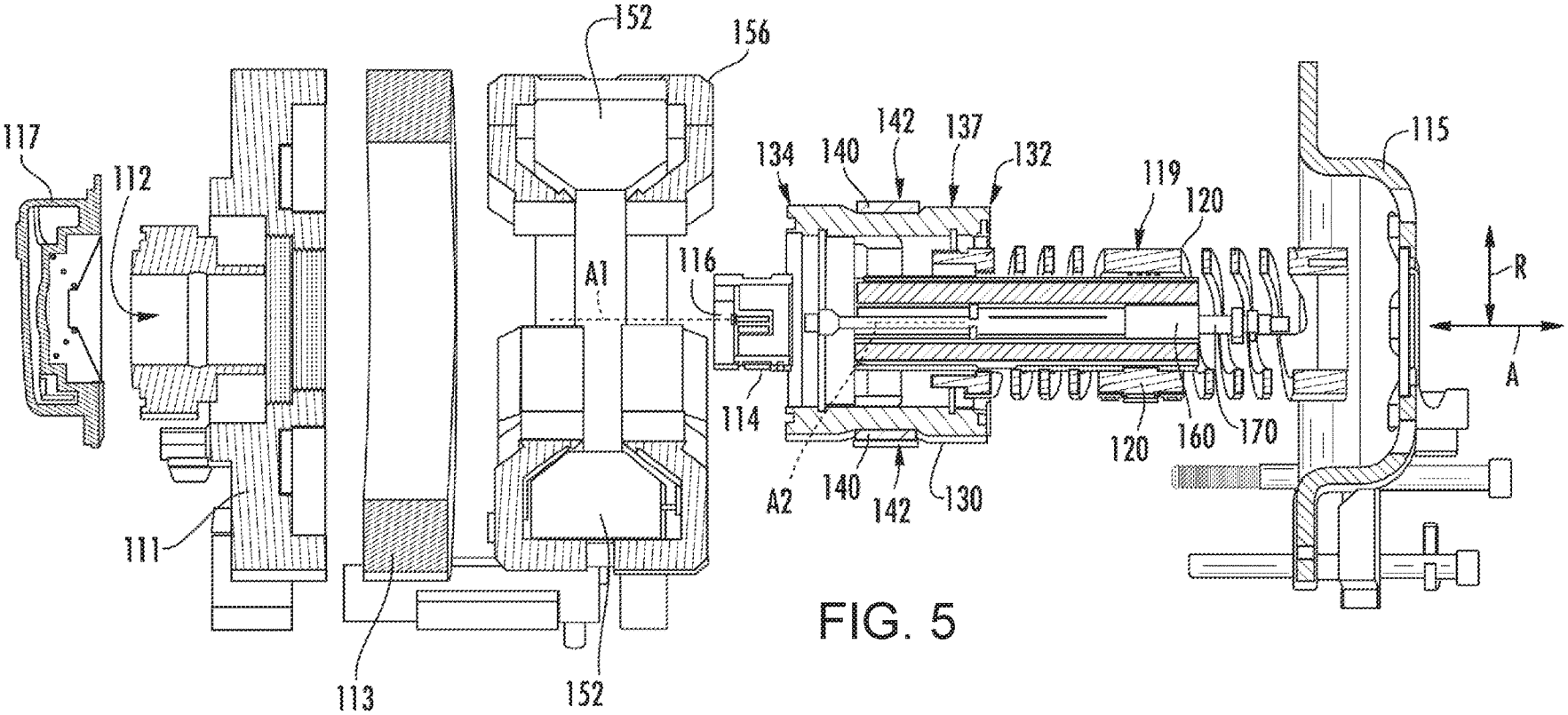
FIG. 5 is an exploded view of the example linear compressor of FIG. 4.

FIG. 3 provides a perspective view of a linear compressor 100 according to an example embodiment of the present subject matter. FIG. 4 provides a side section view of linear compressor 100. FIG. 5 provides an exploded side section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 4, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative example embodiments.

Linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C. Inner back iron assembly 130 extends between a first end portion 132 and a second end portion 134, e.g., along the axial direction A.

Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap AG. Thus, the air gap AG may be defined between opposing surfaces of driving magnet 140 and driving coil 152. Driving magnet 140 may also be mounted or fixed to inner back iron assembly 130 such that an outer surface 142 of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap (e.g., air gap AG) between outer back iron 150 and inner back iron assembly 130 during operation of linear compressor 100, and linear compressor 100 may be more efficient than linear compressors with air gaps on both sides of a driving magnet.

As may be seen in FIG. 4, driving coil 152 extends about inner back iron assembly 130, e.g., along the circumferential direction C. Driving coil 152 is operable to move the inner back iron assembly 130 along a second axis A2 during operation of driving coil 152. The second axis may be substantially parallel to the axial direction A and/or the first axis A1. As an example, driving coil 152 may receive a current from a current source (not shown) in order to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 along the second axis A2 and piston head 116 along the first axis A1 during operation of driving coil 152. Thus, driving coil 152 may slide piston assembly 114 between the top dead center position and the bottom dead center position, e.g., by moving inner back iron assembly 130 along the second axis A2, during operation of driving coil 152.

A piston flex mount 160 is mounted to and extends through inner back iron assembly 130. A coupling 170 extends between piston flex mount 160 and piston assembly 114, e.g., along the axial direction A. Thus, coupling 170 connects inner back iron assembly 130 and piston assembly 114 such that motion of inner back iron assembly 130, e.g., along the axial direction A or the second axis A2, is transferred to piston assembly 114. Piston flex mount 160 defines an input passage 162 that permits refrigerant to flow therethrough.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by supplying voltage to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, field programmable gate arrays (FPGA), and the like) to perform control functionality instead of relying upon software.

Linear compressor 100 also includes a spring assembly 120. Spring assembly 120 is positioned in inner back iron assembly 130. In particular, inner back iron assembly 130 may extend about spring assembly 120, e.g., along the circumferential direction C. Spring assembly 120 also extends between first and second end portions 102 and 104 of casing 110, e.g., along the axial direction A. Spring assembly 120 assists with coupling inner back iron assembly 130 to casing 110, e.g., cylinder assembly 111 of casing 110. In particular, inner back iron assembly 130 is fixed to spring assembly 120 at a middle portion 119 of spring assembly 120.

During operation of driving coil 152, spring assembly 120 supports inner back iron assembly 130. In particular, inner back iron assembly 130 is suspended by spring assembly 120 within the stator or the motor of linear compressor 100 such that motion of inner back iron assembly 130 along the radial direction R is hindered or limited while motion along the second axis A2 is relatively unimpeded. Thus, spring assembly 120 may be substantially stiffer along the radial direction R than along the axial direction A. In such a manner, spring assembly 120 can assist with maintaining a uniformity of the air gap AG between driving magnet 140 and driving coil 152, e.g., along the radial direction R, during operation of the motor and movement of inner back iron assembly 130 on the second axis A2. Spring assembly 120 can also assist with hindering side pull forces of the motor from transmitting to piston assembly 114 and being reacted in cylinder assembly 111 as a friction loss.

The various mechanical and electrical parameters or constants of linear compressor 100 may be established or determined in any suitable manner. For example, the various mechanical and electrical parameters or constants of linear compressor 100 may be established or determined using the methodology described in U.S. Patent Publication No. 2016/0215772, which is hereby incorporated by reference in its entirety. For example, the methodology described in U.S. Patent Publication No. 2016/0215772 may be used to determine or establish a spring constant of spring assembly 120, a motor force constant of the motor of linear compressor 100, a damping coefficient of linear compressor 100, a resistance of the motor of linear compressor 100, an inductance of the motor of linear compressor 100, a moving mass (such as mass of piston assembly 114 and inner back iron assembly 130) of linear compressor 100, etc. Knowledge of such mechanical and electrical parameters or constants of linear compressor 100 may improve performance or operation of linear compressor 100. In alternative example embodiments, a manufacturer of linear compressor 100 may provide nominal values for the various mechanical and electrical parameters or constants of linear compressor 100. The various mechanical and electrical parameters or constants of linear compressor 100 may also be measured or estimated using any other suitable method or mechanism.

Figure 6:
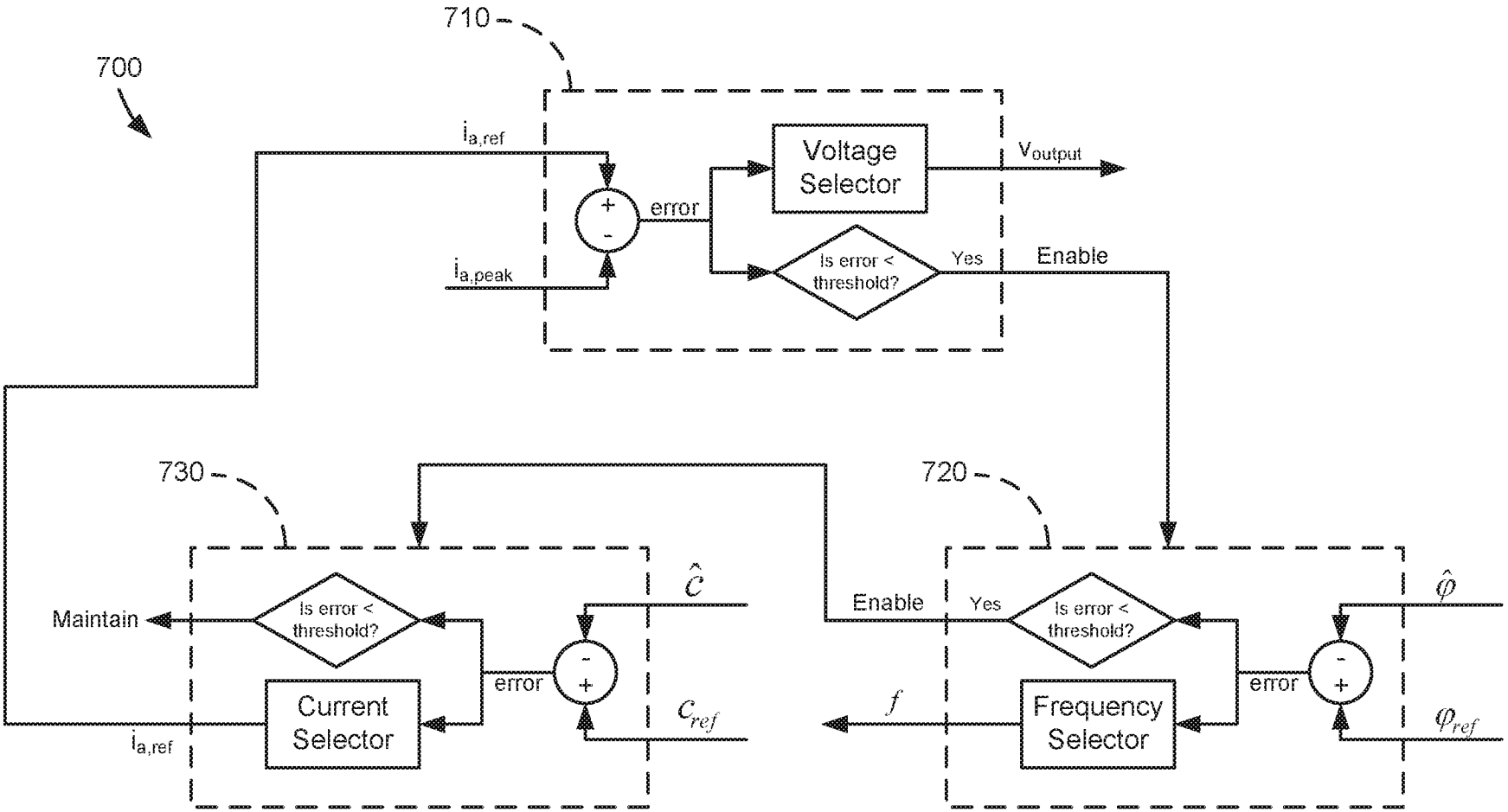
FIG. 6 illustrates a method for operating a linear compressor according to another example embodiment of the present subject matter.

FIG. 6 illustrates a method 700 for operating a linear compressor according to another example embodiment of the present subject matter. Method 700 may be used to operate any suitable linear compressor. For example, method 700 may be used to operate linear compressor 100 (FIG. 3). The controller of method 700 may be programmed or configured to implement method 700. Thus, method 700 is discussed in greater detail below with reference to linear compressor 100. Utilizing method 700, the motor of linear compressor 100 may be operating according to various control methods.

As may be seen in FIG. 6, method 700 includes providing a current controller 710, a resonance controller 720 and a clearance controller 730. Method 700 selectively operates linear compressor with one of current controller 710, resonance controller 720 and clearance controller 730. Thus, at least one of current controller 710, resonance controller 720 and clearance controller 730 selects or adjusts operational parameters of the motor of linear compressor 100, e.g., in order to efficiently reciprocate piston assembly 114 and compress fluid within chamber 112. Switching between current controller 710, resonance controller 720 and clearance controller 730 may improve performance or operation of linear compressor 100, as discussed in greater detail below.

Current controller 710 may be the primary control for operation of linear compressor 100 during method 700. Current controller 710 is configured for adjusting the supply voltage $v_{output}$ to linear compressor 100. For example, current controller 710 may be configured to adjust a peak voltage or amplitude of the supply voltage $v_{output}$ to linear compressor 100. Current controller 710 may adjust the supply voltage $v_{output}$ in order to reduce a difference or error between a peak current, $i_{a,peak}$, supplied to linear compressor 100 and a reference peak current $i_{a,ref}$. The peak current $i_{a,peak}$ may be measured or estimated utilizing any suitable method or mechanism. For example, an ammeter may be used to measure the peak current $i_{a,peak}$. The voltage selector of current controller 710 may operate as a proportional-integral (PI) controller in order to reduce the error between the peak current $i_{a,peak}$ and the reference peak current $i_{a,ref}$. At a start of method 700, the reference peak current $i_{a,ref}$ may be a default value, and clearance controller 730 may adjust (e.g., increase or decrease) the reference peak current $i_{a,ref}$ during subsequent steps of method 700, as discussed in greater detail below, such that method 700 reverts to current controller 710 in order to adjust the amplitude of the supply voltage $v_{output}$ and reduce the error between the peak current $i_{a,peak}$ supplied to linear compressor 100 and the adjusted reference peak current $i_{a,ref}$ from clearance controller 730.

Figure 7:
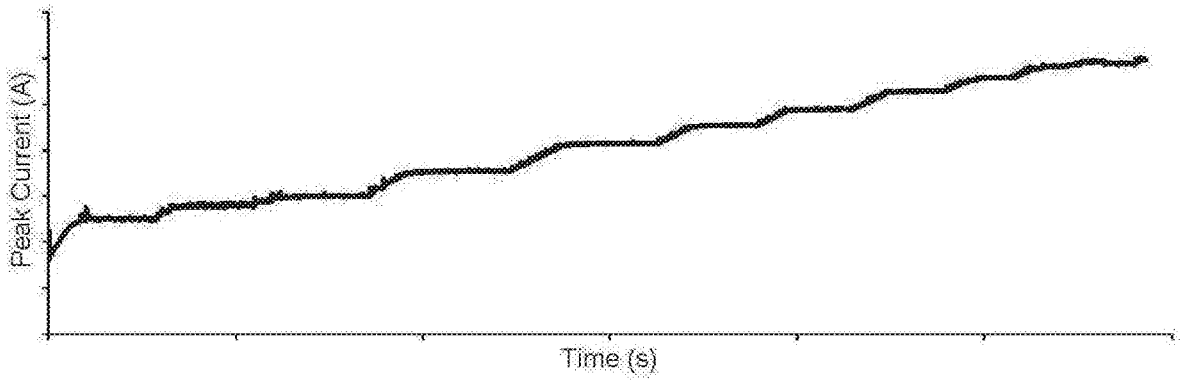
FIGS. 7, 8 and 9 illustrate example plots of various operating conditions of the linear compressor during the method of FIG. 6.
Figure 8:
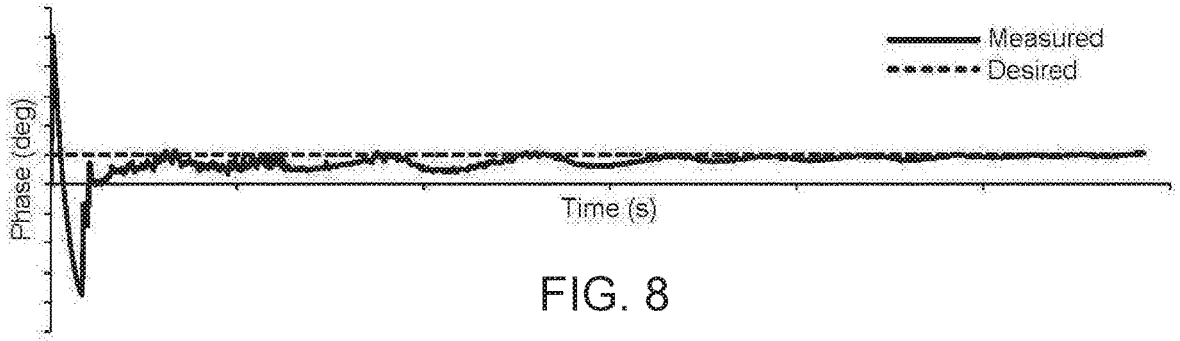

As shown in FIG. 6, current controller 710 continues to determine or regulate the amplitude of the supply voltage $v_{output}$ when the error between the peak current $i_{a,peak}$ and the reference peak current $i_{a,ref}$ is greater than (e.g., or outside) a threshold current error. Conversely, current controller 710 passes off determining or regulating the supply voltage $v_{output}$ to resonance controller 720 when the error between the peak current $i_{a,peak}$ and the reference peak current $i_{a,ref}$ is less than (e.g., or within) the threshold current error. Thus, when the current induced the motor of linear compressor 100 settles, method 700 passes control of the supply voltage $v_{output}$ from current controller 710 to resonance controller 720, e.g., as shown in FIGS. 7 and 8. However, it should be understood that current controller 710 may be always activated or running during method 700, e.g., such that current controller 710 is always determining or regulating the supply voltage $v_{output}$ to ensure that the error between the peak current $i_{a,peak}$ and the reference peak current $i_{a,ref}$ is greater than (e.g., or outside) the threshold current error.

Resonance controller 720 is configured for adjusting the supply voltage $v_{output}$. For example, when activated or enabled, resonance controller 720 may adjust the phase or frequency of the supply voltage $v_{output}$ in order to reduce a phase difference or error between a reference phase, $\varphi_{ref}$, and a phase between (e.g., zero crossings of) an observed velocity, $\hat{v}$ or $\dot{\hat{x}}$, of the motor linear compressor 100 and a current, $i_a$, induced in the motor of linear compressor 100. The reference phase $\varphi_{ref}$ may be any suitable phase. For example, the reference phase $\varphi_{ref}$ may be ten degrees. As another example, the reference phase $\varphi_{ref}$ may be one degree. Thus, resonance controller 720 may operate to regulate the supply voltage $v_{output}$ in order to drive the motor linear compressor 100 at about a resonant frequency. As used herein, the term "about" means within five degrees of the stated phase when used in the context of phases.

For the resonance controller 720, the current $i_a$ induced in the motor of linear compressor 100 may be measured or estimated utilizing any suitable method or mechanism. For example, an ammeter may be used to measure the current $i_a$. The observed velocity $\dot{\hat{x}}$ of the motor linear compressor 100 may be estimated or observed utilizing an electrical dynamic model for the motor of linear compressor 100. Any suitable electrical dynamic model for the motor of linear compressor 100 may be utilized. For example, the electrical dynamic model for the motor of linear compressor 100 described above for step 610 of method 600 may be used. The electrical dynamic model for the motor of linear compressor 100 may also be modified such that $$\frac{di}{dt} = \frac{v_a}{L_i} - \frac{r_i i}{L_i} - f$$

$$\text{where } f = \frac{\alpha}{L_i}\dot{x}.$$

A back-EMF of the motor of linear compressor 100 may be estimated using at least the electrical dynamic model for the motor of linear compressor 100 and a robust integral of the sign of the error feedback. As an example, the back-EMF of the motor of linear compressor 100 may be estimated by solving $$\hat{f} = (K_1+1)e(t) + \int_{t_0}^{t}[(K_1+1)e(\sigma) + K_2\,\mathrm{sgn}(e(\sigma))]d\sigma - (K_1+1)e(t_0)$$

where $\hat{f}$ is an estimated back-EMF of the motor of linear compressor 100;

$K_1$ and $K_2$ are real, positive gains; and $e = \hat{i} - i$ and $\dot{e} = f - \hat{f}$; and sgn(•) is the signum or sign function.

In turn, the observed velocity $\hat{\dot{x}}$ of the motor of linear compressor 100 may be estimated based at least in part on the back-EMF of the motor. For example, the observed velocity $\hat{\dot{x}}$ of the motor of linear compressor 100 may be determined by solving $$\hat{\dot{x}} = \frac{L_i}{\alpha}\hat{f}$$

where $\hat{\dot{x}}$ is the estimated or observed velocity $\dot{x}$ of the motor of linear compressor 100;

$\alpha$ is a motor force constant; and $L_i$ is an inductance of the motor of linear compressor 100.

The motor force constant and the inductance of the motor of linear compressor 100 may be estimated with method 600, as described above.

Figure 9:
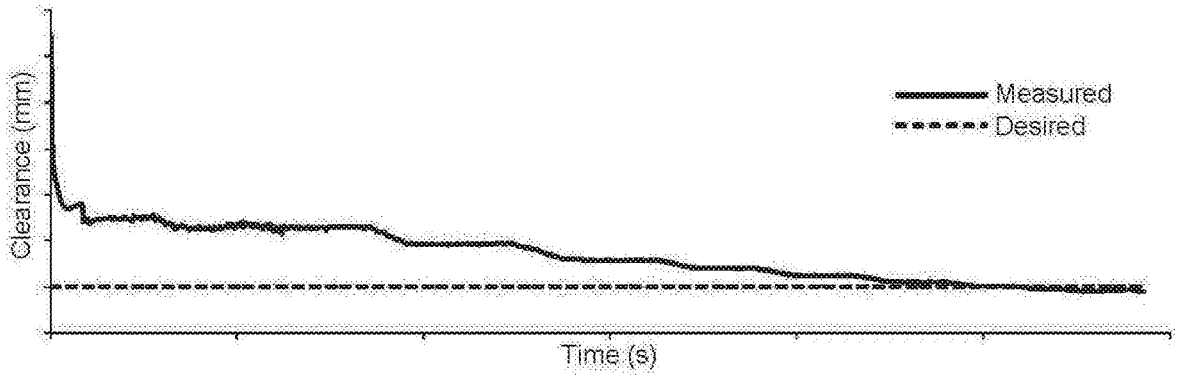

As shown in FIG. 6, resonance controller 720 continues to determine or regulate the frequency of the supply voltage $v_{output}$ when the error between the reference phase $\varphi_{ref}$ and the phase between the observed velocity $\hat{\dot{x}}$ and the current $i_a$ is greater than (e.g., or outside) a threshold phase error. Conversely, resonance controller 720 passes off determining or regulating the supply voltage $v_{output}$ to clearance controller 730 when the error between the reference phase $\varphi_{ref}$ and the phase between the observed velocity $\hat{\dot{x}}$ and the current $i_a$ is less than (e.g., or within) the threshold phase error. Thus, when the motor linear compressor 100 is operating at about a resonant frequency, method 700 passes control of the supply voltage $v_{output}$ from resonance controller 720 to clearance controller 730, e.g., as shown in FIGS. 8 and 9.

The threshold phase error may be any suitable phase. For example, the voltage selector of resonance controller 720 may utilize multiple threshold phase errors in order to more finely or accurately adjust the phase or frequency of the supply voltage $v_{output}$ to achieve a desired frequency for linear compressor 100. For example, a first threshold phase error, a second threshold phase error and a third threshold phase error may be provided and sequentially evaluated by the voltage selector of resonance controller 720 to adjust the frequency during method 700. The first phase clearance error may be about twenty degrees, and resonance controller 720 may successively adjust (e.g., increase or decrease) the frequency by about one hertz until the error between the reference phase $\varphi_{ref}$ and the phase between the observed velocity $\hat{\dot{x}}$ and the current $i_a$ is less than the first threshold phase error. The second threshold phase error may be about five degrees, and resonance controller 720 may successively adjust (e.g., increase or decrease) the frequency by about a tenth of a hertz until the error between the reference phase $\varphi_{ref}$ and the phase between the observed velocity $\hat{\dot{x}}$ and the current $i_a$ is less than the second threshold phase error. The third threshold phase error may be about one degree, and resonance controller 720 may successively adjust (e.g., increase or decrease) the frequency by about a hundredth of a hertz until the error between the reference phase $\varphi_{ref}$ and the phase between the observed velocity $\hat{\dot{x}}$ and the current $i_a$ is less than the third threshold phase error. As used herein, the term "about" means within ten percent of the stated frequency when used in the context of frequencies.

Clearance controller 730 is configured for adjusting the reference peak current $i_{a,ref}$. For example, when activated or enabled, clearance controller 730 may adjust the reference peak current $i_{a,ref}$ in order to reduce a difference or error between an observed clearance, $\hat{c}$, of the motor of linear compressor 100 and a reference clearance, $c_{ref}$. Thus, clearance controller 730 may operate to regulate the reference peak current $i_{a,ref}$ in order to drive the motor linear compressor 100 at about a particular clearance between piston head 116 and discharge valve assembly 117. The reference clearance $c_{ref}$ may be any suitable distance. For example, the reference clearance $c_{ref}$ may be about two millimeters, about one millimeter or about a tenth of a millimeter. As used herein, the term "about" means within ten percent of the stated clearance when used in the context of clearances.

As shown in FIG. 6, clearance controller 730 continues to determine or regulate the reference peak current $i_{a,ref}$, e.g., when the error between the observed clearance $\hat{c}$ of the motor of linear compressor 100 and a reference clearance $c_{ref}$ is greater than (e.g., or outside) a threshold clearance error. Thus, clearance controller 730 operates the motor linear compressor 100 to avoid head crashing. When, the error between the observed clearance $\hat{c}$ of the motor of linear compressor 100 and the reference clearance $c_{ref}$ is less than (e.g., or inside) the threshold clearance error, method 700 may maintain linear compressor 100 at current operation conditions, e.g., such that the supply voltage $v_{output}$ is stable or regular.

The threshold clearance error may be any suitable clearance. For example, the voltage selector of clearance controller 730 may utilize multiple threshold clearance errors in order to more finely or accurately adjust the supply voltage $v_{output}$ to achieve a desired clearance. In particular, a first threshold clearance error, a second threshold clearance error and a third threshold clearance error may be provided and sequentially evaluated by the voltage selector of clearance controller 730 to adjust a magnitude of a change to the current $i_a$ during method 700. The first threshold clearance error may be about two millimeters, and clearance controller 730 may successively adjust (e.g., increase or decrease) the current $i_a$ by about twenty milliamps until the error between the observed clearance $\hat{c}$ of the motor of linear compressor 100 and the reference clearance $c_{ref}$ is less than the first threshold clearance error. The second threshold clearance error may be about one millimeter, and clearance controller 730 may successively adjust (e.g., increase or decrease) the current $i_a$ by about ten milliamps until the error between the observed clearance $\hat{c}$ of the motor of linear compressor 100 and the reference clearance $c_{ref}$ is less than the second threshold clearance error. The third threshold clearance error may be about a tenth of a millimeter, and clearance controller 730 may successively adjust (e.g., increase or decrease) the current $i_a$ by about five milliamps until the error between the observed clearance $\hat{c}$ of the motor of linear compressor 100 and the reference clearance $c_{ref}$ is less than the third threshold clearance error. As used herein, the term "about" means within ten percent of the stated current when used in the context of currents.

As discussed above, current controller 710 determines or regulates the amplitude of the supply voltage $v_{output}$ when the error between the peak current $i_{a,peak}$ and the reference peak current $i_{a,ref}$ is greater than (e.g., or outside) a threshold current error. By modifying the reference peak current $i_{a,ref}$, clearance controller 730 may force the error between the peak current $i_{a,peak}$ and the reference peak current $i_{a,ref}$ to be greater than (e.g., or outside) the threshold current error. Thus, priority may shift back to current controller 710 after clearance controller 730 adjusts the reference peak current $i_{a,ref}$, e.g., until current controller 710 again settles the current induced in the motor of linear compressor 100 as described above.

It should be understood that method 700 may be performed with the motor of linear compressor 100 sealed within a hermitic shell of linear compressor 100. Thus, method 700 may be performed without directly measuring velocities or positions of moving components of linear compressor 100. Utilizing method 700, the supply voltage $v_{output}$ may be adjusted by current controller 710, resonance controller 720 and/or clearance controller 730 in order to operate the motor of linear compressor 100 at a resonant frequency of the motor of linear compressor 100 without or limited head crashing. Thus, method 700 provides robust control of clearance and resonant tracking, e.g., without interference and run away conditions. For example, current controller 710 may be always running and tracking the peak current $i_{a,peak}$, e.g., as a PI controller, and resonant controller 720 and clearance controller 730 provide lower priority controls, with resonant controller 720 having a higher priority relative to clearance controller 730.

Figure 10:
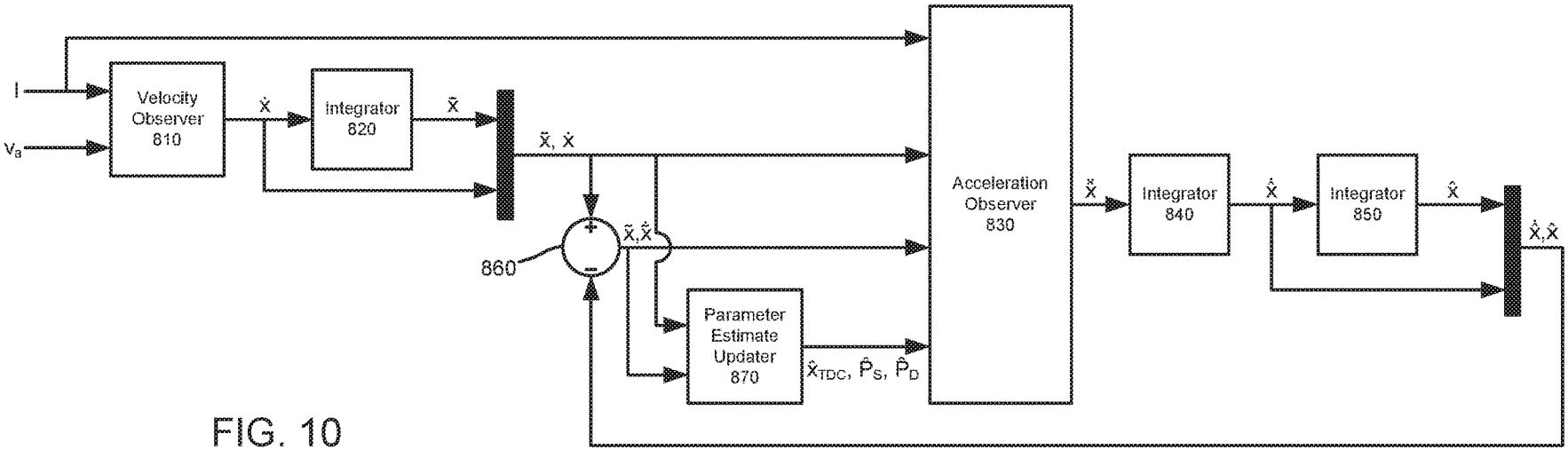
FIG. 10 illustrates a method for operating a linear compressor according to another example embodiment of the present subject matter.

FIG. 10 illustrates a system 800 for operating a linear compressor according to another example embodiment of the present subject matter. System 800 may be used to operate any suitable linear compressor. For example, system 800 may be used to operate linear compressor 100 (FIG. 3). System 800 is described in greater detail below in the context of linear compressor 800.

—ystem 800 utilizes a first observed velocity, e.g., calculated using the robust integral of the sign of the error feedback and the electrical dynamic model described above for resonant controller 720, and treats the first observed velocity as a true velocity, $\dot{\hat{x}}(t)$, and a bounded integral of the first observed velocity as a shifted true position, x(t), where $x(t)=\bar{x}(t)+x_{TDC}$. By substituting $\dot{x}(t)$ and $\bar{x}(t)$ into a mechanical dynamic model, the unknowns in the mechanical dynamic model can be reduced to the three constants (or slowly time-varying values), namely a top dead center position or clearance, $x_{TDC}$, a discharge pressure, $P_d$, and a suction pressure, $P_s$. With initial estimates for the clearance $x_{TDC}$, the discharge pressure $P_d$ and the suction pressure $P_s$, the mechanical dynamic model can be used to calculate an observed acceleration, $\ddot{\hat{x}}(t)$. The observed acceleration $\ddot{\hat{x}}(t)$ may be integrated twice to obtain a second observed velocity, $\dot{\hat{x}}(t)$, and an observed position, $\hat{x}(t)$. The second observed velocity $\dot{\hat{x}}(t)$ can be compared to the first observed velocity $\dot{x}(t)$, and the observed position $\hat{x}(t)$ can be compared to $\bar{x}(t)$. The two error signals can be used to update estimates for the clearance $x_{TDC}$, the discharge pressure $P_d$ and the suction pressure $P_s$. In such a manner, accurate estimates of the clearance $x_{TDC}$, the discharge pressure $P_d$ and the suction pressure $P_s$ may be obtained with system 800. System 800 is discussed in greater detail in the context of FIGS. 10 through 13.

At velocity observer 810, system 800 calculates the first observed velocity $\dot{x}(t)$. As shown in FIG. 10, velocity observer 810 may receive as inputs: an input current, I, through the motor of linear compressor 100; and an input voltage, $v_a$, supplied to the motor of linear compressor 100. Velocity observer 810 uses the inputs I and $v_a$ with an electrical dynamic model for the motor of and a robust integral of the sign of the error feedback to calculate the first observed velocity $\dot{x}(t)$, e.g., using the formulas and method described above for resonance controller 720.

At integrator 830, system 800 calculates a bounded integral of the first observed velocity $\dot{x}(t)$. An unavoidable DC bias within the input current I results in a small DC bias in the first observed velocity $\dot{x}(t)$. Thus, the integral of the first observed velocity $\dot{x}(t)$ is normally unbounded. System 800 periodically resets the integrator to avoid an unbounded integral. For example, the minimum of the position, x(t), or top dead center of piston assembly 114 occurs the rising zero-cross of the first observed velocity $\dot{x}(t)$. Thus, resetting the integrator to zero at the rising zero-cross of the first observed velocity $\dot{x}(t)$ each cycle results in $\bar{x}(t)$ being bounded with a minimum of zero. Since $\bar{x}(t)$ has a minimum of zero while the position x(t) has a minimum of $x_{TDC}$, the following relationship holds $x(t)=\bar{x}(t)+x_{TDC}$. Thus, the bounded integral of the first observed velocity $\dot{x}(t)$ may correspond to x(t). Alternatively, the integral of the first observed velocity $\dot{x}(t)$ may be filtered, e.g., with a high-pass filter, to remove the DC bias and keep the signal bounded. Thus, x(t) may be generally defined such that $x(t)=\bar{x}(t)+x_0$, where $x_0$ is an unknown constant shift between the bounded velocity integral and the actual position.

At acceleration observer 830, the first observed velocity $\dot{x}(t)$ and the bounded integral $\bar{x}(t)$ and the input current I are substituted or input into a mechanical dynamic model for the motor. In addition, an initial estimated clearance $\hat{x}_{TDC}$, an initial estimated discharge pressure, $\hat{P}_D$, and an initial estimated suction pressure, $\hat{P}_S$, are also substituted or input into the mechanical dynamic model for the motor. The initial estimates of the clearance $\hat{x}_{TDC}$ the discharge pressure $\hat{P}_D$ and the suction pressure $\hat{P}_S$ may be default values, e.g., selected by a manufacturer of linear compressor 100 based upon empirical clearance and pressure data for linear compressor 100.

With the inputs described above, acceleration observer 830 calculates the observed acceleration $\ddot{x}(t)$ for piston assembly 114 with the mechanical dynamic model for the motor. As an example, acceleration observer 830 may calculate the observed acceleration $\ddot{\hat{x}}(t)$ by solving $$\ddot{\hat{x}} = \frac{1}{M}\left[\alpha I + A_p\left(\int \dot{W}\hat{\theta} - \hat{P}_S\right) - C\dot{\hat{x}} - K(\bar{x} + \hat{x}_{TDC} - L_0)\right]$$

where

M is a moving mass of the piston, $\alpha$ is a motor force constant, $A_p$ is a cross-sectional area of the piston, $\dot{W}$ is a piecewise regressor derivative defined in the following table,

| Piecewise Condition | $\dot{W}_1$ | $\dot{W}_2$ |
|---|---|---|
| $\dot{x} < 0$, $\hat{P}(t) < \hat{P}_D$ | $-n\left(\frac{X_{BDC}}{x(t)}\right)^n \frac{\dot{x}(t)}{x(t)}$ | 0 |
| $\dot{x} < 0$, $\hat{P}(t) \geq \hat{P}_D$ | 0 | 0 |
| $\dot{x} > 0$, $\hat{P}(t) > \hat{P}_D$ | 0 | $-n\left(\frac{X_{TDC}}{x(t)}\right)^n \frac{\dot{x}(t)}{x(t)}$ |
| $\dot{x} > 0$, $\hat{P}(t) \leq \hat{P}_D$ | 0 | 0 |

$\hat{\theta}$ is a matrix $[\hat{P}_S\ \hat{P}_D]^T$, $X_{BDC}$ is the bottom dead center position of the piston, $X_{TDC}$ is the top dead center position of the piston, $\hat{P}(t)$ is an observed chamber pressure, n is an adiabatic index, $L_0$ is an equilibrium position of the piston, C is a damping coefficient of the linear compressor, and K is a spring stiffness of the linear compressor.

Acceleration observer 830 may output the observed acceleration $\hat{\ddot{x}}(t)$ to other components of system 800.

With the inputs described above, acceleration observer 830 calculates the observed acceleration $\hat{\ddot{x}}(t)$ for piston assembly 114 with the mechanical dynamic model for the motor. As an example, acceleration observer 830 may calculate the observed acceleration $\hat{\ddot{x}}(t)$ by solving $$\ddot{\hat{x}} = \frac{1}{M}\left[\alpha I + A_p\left(\int \dot{W}\hat{\theta} - \hat{P}_S\right) - C\dot{x} - K(\bar{x} + \hat{x}_{TDC} - L_0)\right]$$

where

M is a moving mass of the piston, $\alpha$ is a motor force constant, $A_p$ is a cross-sectional area of the piston, $\dot{W}$ is a piecewise regressor derivative defined in the following table,

| Piecewise Condition | $\dot{W}_1$ | $\dot{W}_2$ |
|---|---|---|
| $\dot{x} < 0$, $\hat{P}(t) < \hat{P}_D$ | $-n\left(\frac{X_{BDC}}{x(t)}\right)^n \frac{\dot{x}(t)}{x(t)}$ | 0 |
| $\dot{x} < 0$, $\hat{P}(t) \geq \hat{P}_D$ | 0 | 0 |
| $\dot{x} > 0$, $\hat{P}(t) > \hat{P}_D$ | 0 | $-n\left(\frac{X_{TDC}}{x(t)}\right)^n \frac{\dot{x}(t)}{x(t)}$ |
| $\dot{x} > 0$, $\hat{P}(t) \leq \hat{P}_D$ | 0 | 0 |

$\hat{\theta}$ is a matrix $[\hat{P}_S\ \hat{P}_D]^T$, $\hat{P}(t)$ is an observed chamber pressure, n is an adiabatic index, $L_0$ is an equilibrium position of the piston, C is a damping coefficient of the linear compressor, and K is a spring stiffness of the linear compressor.

Acceleration observer 830 may output the observed acceleration $\hat{\ddot{x}}(t)$ to other components of system 800.

At integrator 840, system 800 calculates the second observed velocity $\hat{\dot{x}}(t)$ by integrating the observed acceleration $\hat{\ddot{x}}(t)$. Similarly, system 800 calculates the observed position $\hat{x}(t)$ by integrating the second observed velocity $\hat{\dot{x}}(t)$ at integrator 850. Thus, the second observed velocity $\hat{\dot{x}}(t)$ from acceleration observer 830 may be integrated twice to calculate the second observed velocity $\hat{\dot{x}}(t)$ and the observed position $\hat{x}(t)$.

At comparator 860, system 800 determines a difference or error between the first observed velocity $\dot{x}(t)$ and the second observed velocity $\hat{\dot{x}}(t)$. System 800 also determines a difference or error between the bounded integral $\bar{x}(t)$ and the observed position $\hat{x}(t)$ at comparator 860. The errors from comparator 860 may be input into a parameter estimate updater 870 in order to update the initial estimates of the clearance $\hat{x}_{TDC}$ the discharge pressure $\hat{P}_D$ and the suction pressure $\hat{P}_S$. In addition, the errors from comparator 860 may be input into acceleration observer 830. Thus, the errors from comparator 860 may be used to update estimates for the clearance $\hat{x}_{TDC}$ the discharge pressure $\hat{P}_D$ and the suction pressure $\hat{P}_S$ and may also be used in acceleration observer 830 to calculate the observed acceleration $\hat{\ddot{x}}(t)$, e.g., during subsequent strokes of piston assembly 114.

At parameter estimate updater 870, system 800 updates estimates for the clearance $\hat{x}_{TDC}$ the discharge pressure $\hat{P}_D$ and the suction pressure $\hat{P}_S$, e.g., based upon the errors calculated at comparator 860. For example, parameter estimate updater 870 may update the discharge pressure $\hat{P}_D$ and the suction pressure $\hat{P}_S$ by integrating $$\dot{\hat{\theta}} = \frac{A_p}{M}\Gamma W^T r$$

where $\dot{\hat{\theta}}$ is a derivative of the matrix $[\hat{P}_S\ \hat{P}_D]^T$, $\Gamma$ is a diagonal gain matrix, r is a sum of $\dot{\tilde{x}}$ and a product of $k_1$ and $\tilde{x}$, i.e., $r=\dot{\tilde{x}}+k_1\tilde{x}$, $\dot{\tilde{x}}$ is the error between the first observed velocity $\dot{x}(t)$ and the second observed velocity $\hat{\dot{x}}(t)$, i.e., $\dot{\tilde{x}}=\dot{x}(t)-\hat{\dot{x}}(t)$, $\tilde{x}$ is the error between the bounded integral $\bar{x}(t)$ and the observed position $\hat{x}(t)$, i.e., $\tilde{x}=\bar{x}(t)-\hat{x}(t)$, and $k_1$ is an observer gain.

In such a manner, system 800 may calculate updated estimates for the clearance $\hat{x}_{TDC}$, the discharge pressure $\hat{P}_D$ and the suction pressure $\hat{P}_S$ with parameter estimate updater 870. The updated estimates for clearance $\hat{x}_{TDC}$ the discharge pressure $\hat{P}_D$ and the suction pressure $\hat{P}_S$ by acceleration observer 830 in a next instant to assist with calculating the observed acceleration $\hat{\ddot{x}}(t)$ in the next instant.

As noted above, the errors from comparator 860 may be input into acceleration observer 830. Thus, the errors from comparator 860 in a previous instant may assist acceleration observer 830 with more accurately calculating the observed acceleration $\hat{\ddot{x}}(t)$ during in the next instant. For example, acceleration observer 830 may calculate the observed acceleration $\hat{\ddot{x}}(t)$ by solving $$\ddot{\tilde{x}} = \frac{1}{M}\left[\alpha I + A_p\left(\int \dot{W}\hat{\theta} - \hat{P}_S\right) - C\dot{x} - K(\bar{x} + \hat{x}_{TDC} - L_0)\right] + k_1\dot{\tilde{x}} + \tilde{x} + k_2 r$$

where $k_2$ is another observer gain.

In such a manner, feedback from the preceding stroke of piston assembly 114 assists with calculating the observed acceleration $\hat{\ddot{x}}(t)$ in the next instant and with updating the estimates for clearance $\hat{x}_{TDC}$ the discharge pressure $\hat{P}_D$ and the suction pressure $\hat{P}_S$.

Figure 11:
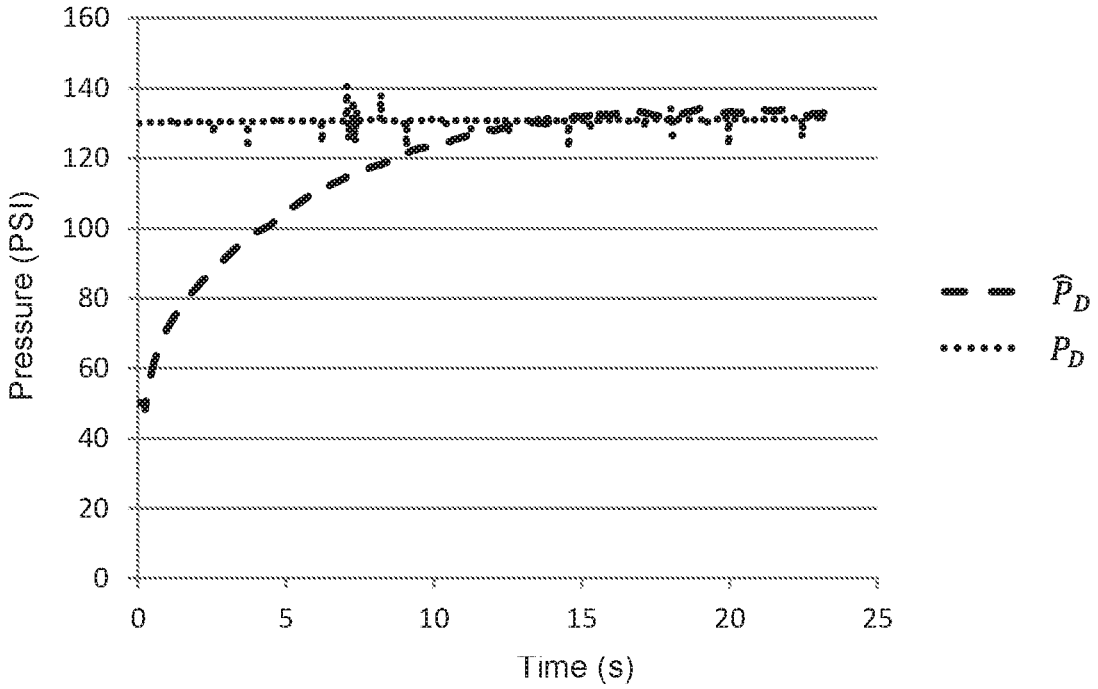
FIG. 11 illustrates example plots of an observed discharge pressure and an actual discharge pressure versus time during the method of FIG. 10.
Figure 12:
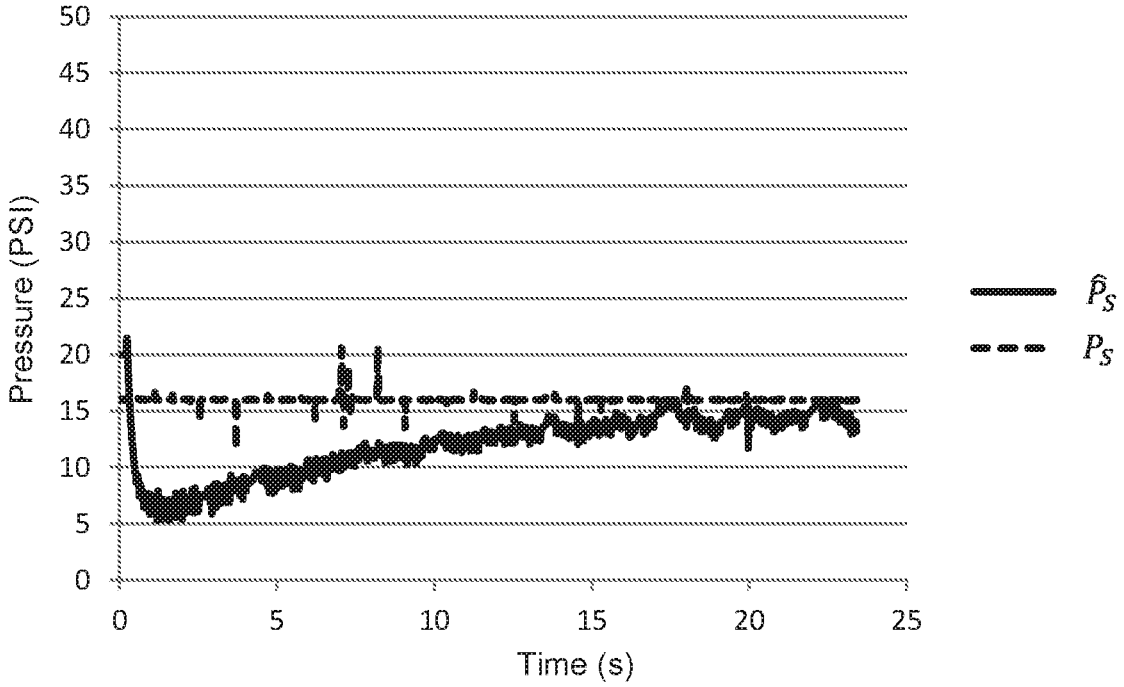
FIG. 12 illustrates example plots of an observed suction pressure and an actual suction pressure versus time during the method of FIG. 10.
Figure 13:
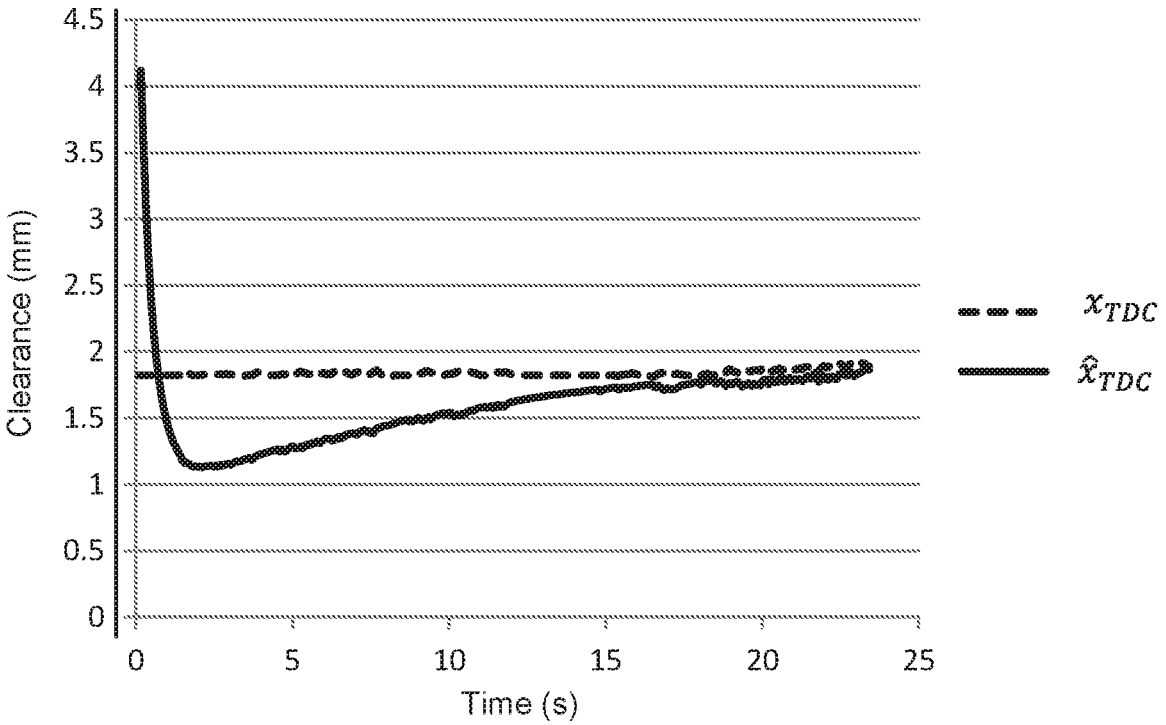
FIG. 13 illustrates example plots of an observed clearance and an actual clearance versus time during the method of FIG. 10.

As may be seen from the above, system 800 may start with initial estimates for the clearance $\hat{x}_{TDC}$, the discharge pressure $\hat{P}_D$ and the suction pressure $\hat{P}_S$, and system 800 may update such estimates over time so that the estimates converge towards actual values of the clearance $\hat{x}_{TDC}$, the discharge pressure $\hat{P}_D$ and the suction pressure $\hat{P}_S$. The plots in FIGS. 11, 12 and 13 illustrate convergence of the estimates for the clearance $\hat{x}_{TDC}$, the discharge pressure $\hat{P}_D$ and the suction pressure $\hat{P}_S$ from parameter estimate updater 870 towards their respective actual (measured) values over time during a experimental trial of system 800. Thus, system 800 may assist with accurately estimating the clearance $\hat{x}_{TDC}$, the discharge pressure $\hat{P}_D$ and the suction pressure $\hat{P}_S$ during operation of linear compressor 100, e.g., without a position sensor or a pressure sensor, and system 800 may be sensorless.

In addition, the table provided below shows additional experimental data accumulated while operating a compressor with system 800.

| Input Current (A) | Actual Discharge Pressure (psi) | Observed Discharge Pressure (psi) | Actual Suction Pressure (psi) | Observed Suction Pressure (psi) | Actual Clearance (mm) | Observed Clearance (mm) |
|---|---|---|---|---|---|---|
| 0.5 | 44.5 | 42.2 | 13.7 | 11.1 | 2.23 | 2.19 |
| 0.7 | 58.0 | 56.2 | 13.3 | 10.0 | 1.42 | 1.39 |
| 0.9 | 69.8 | 71.0 | 13.1 | 10.2 | 0.84 | 0.86 |
| 1.1 | 107.4 | 109.6 | 11.9 | 10.7 | 0.72 | 0.82 |
| 0.5 | 73.5 | 69.9 | 13.5 | 12.6 | 2.36 | 2.28 |
| 0.7 | 94.9 | 89.8 | 12.7 | 10.9 | 1.67 | 1.56 |
| 0.9 | 114.0 | 110.9 | 11.9 | 10.6 | 1.21 | 1.15 |
| 1.1 | 132.5 | 131.0 | 11.2 | 10.7 | 0.83 | 0.87 |
| 0.5 | 111.5 | 105.0 | 12.2 | 11.8 | 1.99 | 1.90 |

As may be seen in the table, the experimental estimates of the clearance $\hat{x}_{TDC}$, the discharge pressure $\hat{P}_D$ and the suction pressure $\hat{P}_S$ provided by system 800 accurately track their actual values across a variety of input currents.

In alternative example embodiments, acceleration observer 830 may calculate the observed acceleration $\hat{\ddot{x}}(t)$ by solving $$\ddot{\tilde{x}} = \frac{1}{M}\left[\alpha I + A_p W\hat{\theta} - C\dot{x} - K(\bar{x} + \hat{x}_{TDC} - L_0)\right] + k_1\dot{\tilde{x}} + \tilde{x} + k_2 r$$

where

M is a moving mass of the piston, $\alpha$ is a motor force constant, $A_p$ is a cross-sectional area of the piston, W is a piecewise regressor derivative defined in the following table,

| Piecewise Condition | $W_1$ | $W_2$ |
|---|---|---|
| $\dot{x} < 0$, $\hat{P}(t) < \hat{P}_D$ | $\left(\frac{X_{BDC}}{x(t)}\right)^n - 1$ | 0 |
| $\dot{x} < 0$, $\hat{P}(t) \geq \hat{P}_D$ | −1 | 1 |
| $\dot{x} > 0$, $\hat{P}(t) > \hat{P}_D$ | −1 | $\left(\frac{X_{TDC}}{x(t)}\right)^n$ |
| $\dot{x} > 0$, $\hat{P}(t) \leq \hat{P}_D$ | 0 | 0 |

$\hat{\theta}$ is a matrix $[\hat{P}_S\ \hat{P}_D]^T$, $\hat{P}(t)$ is a chamber pressure, with $\hat{P}(t) \triangleq (W_1+1)\hat{P}_S + W_2\hat{P}_D$, n is an adiabatic index, $L_0$ is an inductance of the motor, C is a damping coefficient of the linear compressor, and K is a spring stiffness of the linear compressor.

Acceleration observer 830 may output the observed acceleration $\hat{\ddot{x}}(t)$ to other components of system 800.

In such example embodiments, parameter estimate updater 870 may update the discharge pressure $\hat{P}_D$ and the suction pressure $\hat{P}_S$ by integrating $$\dot{\hat{\theta}} = \frac{A_p}{M}\Gamma W^T r$$

in the manner discussed above such that $\delta \triangleq k_p I_2$ is a diagonal gain matrix with $k_p$ being a positive gain. In addition, parameter estimate updater 870 may update the clearance $\hat{x}_{TDC}$ by integrating $$\dot{\hat{x}}_{TDC} = -\frac{k_x K}{M} r$$

where $k_x$ is another positive gain.

In the description above, it is generally assumed that the piston undergoes a complete cycle, i.e., compression, discharge, decompression and suction, as the piston reciprocates between top and bottom dead center positions. However, the piston may only undergo an incomplete cycle, e.g., during short strokes in startup and shutdown of the linear compressor. System 800 may include features for accurately estimating the clearance $\hat{x}_{TDC}$, the discharge pressure $\hat{P}_D$ and the suction pressure $\hat{P}_S$ during incomplete cycles.

In particular, during incomplete cycles, the chamber pressure $\hat{P}(t)$ may be defined in the following table,

| Stage | Piecewise Condition | $\hat{P}(t)$ |
|---|---|---|
| Compression | $\dot{x} < 0$, $\hat{P}(t) < \hat{P}_D$ | $\hat{P}(t_{BDC})\left(\frac{X_{BDC}}{x(t)}\right)^n$ |
| Discharge | $\dot{x} < 0$, $\hat{P}(t) \geq \hat{P}_D$ | $\hat{P}_D$ |
| Decompression | $\dot{x} > 0$, $\hat{P}(t) > \hat{P}_D$ | $\hat{P}(t_{TDC})\left(\frac{X_{TDC}}{x(t)}\right)^n$ |
| Suction | $\dot{x} > 0$, $\hat{P}(t) \leq \hat{P}_D$ | $\hat{P}_S$ |

In addition: (1) during the compression stage, if the previous stage was not the suction stage, then set $\dot{\hat{P}}_S$ to zero; and (2) during the decompression stage, if the previous stage was not the discharge stage, then set $\dot{\hat{P}}_d$ to zero, in order to break feedback and prevent $\hat{P}_s$ and $\hat{P}_d$ from updating.

In the above description, soft crashing occurs when the piston goes past the end of the cylinder, making contact with the discharge valve, i.e., when (t) is less than zero which in the thermodynamic model would imply a negative volume. To account for soft crashing (and avoid the implication of negative volume), the chamber pressure $\hat{P}(t)$ may be defined in the following table,

| Stage | Piecewise Condition | $\hat{P}(t)$ |
|---|---|---|
| Compression | $\dot{x} < 0 \mid x \leq \epsilon$ <br> $\hat{P}(t) < \hat{P}_D$ | $\hat{P}_S\left(\frac{X_{BDC}}{x(t)}\right)^n$ |
| Discharge | $\dot{x} < 0 \mid x \leq \epsilon$ <br> $\hat{P}(t) \geq \hat{P}_D$ | $\hat{P}_D$ |
| Decompression | $\dot{x} > 0 \mid x > \epsilon$ <br> $\hat{P}(t) > \hat{P}_D$ | $\hat{P}_D\left(\frac{X_{TDC}}{x(t)}\right)^n$ |
| Suction | $\dot{x} > 0 \mid x > \epsilon$ <br> $\hat{P}(t) \leq \hat{P}_D$ | $\hat{P}_S$ |

The constant $\in$ may be a small value, e.g., to avoid dividing by zero. Additionally since $\hat{x}_{TDC}$ is negative during soft crash, the value of x(t) as it enters decompression, i.e. $\hat{x}_{TDC} \Rightarrow \in$. Such modifications are applied to the observer definitions for $W_1$, $W_2$.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a linear compressor, comprising:

calculating a first observed velocity for a piston of the linear compressor using at least an electrical dynamic model for a motor of the linear compressor and a robust integral of the sign of the error feedback;

calculating a bounded integral of the first observed velocity;

substituting the first observed velocity and the bounded integral into a mechanical dynamic model for the motor;

estimating a clearance of the piston, a discharge pressure of the linear compressor and a suction pressure of the linear compressor;

substituting the estimated clearance, the estimated discharge pressure, and the estimated suction pressure into the mechanical dynamic model for the motor;

calculating an observed acceleration for the piston with the mechanical dynamic model for the motor;

calculating a second observed velocity for the piston by integrating the observed acceleration for the piston;

calculating an observed position of the piston by integrating the second observed velocity for the piston;

determining an error between the first and second observed velocities and an error between the bounded integral of the first observed velocity and the observed position; and updating the estimated clearance, the estimated discharge pressure, and the estimated suction pressure based upon the error between the first and second observed velocities and the error between the bounded integral of the first observed velocity and the observed position.

2. The method of claim 1, wherein calculating the first observed velocity comprises:

estimating a back-EMF of the motor of the linear compressor using the electrical dynamic model for the motor of the linear compressor and the robust integral of the sign of the error feedback; and determining the first observed velocity of the motor of the linear compressor based at least in part on the back-EMF of the motor.

3. The method of claim 2, wherein the electrical dynamic model for the motor comprises $$\frac{di}{dt} = \frac{v_a}{L_i} - \frac{r_i i}{L_i} - \frac{\alpha \dot{x}}{L_i}$$

where $v_a$ is a voltage across the motor of the linear compressor;

$r_i$ is a resistance of the motor of the linear compressor;

i is a current through the motor of the linear compressor;

$\alpha$ is a motor force constant;

$\dot{x}$ is a velocity of the motor of the linear compressor; and $L_i$ is an inductance of the motor of the linear compressor.

4. The method of claim 3, wherein estimating the back-EMF of the motor of the linear compressor using the robust integral of the sign of the error feedback comprises solving $$\hat{f} = (K_1+1)e(t) + \int_{t_0}^{t}[(K_1+1)e(\sigma) + K_2 \operatorname{sgn}(e(\sigma))]d\sigma - (K_1+1)e(t_0)$$

where $\hat{f}$ is an estimated back-EMF of the motor of the linear compressor;

$K_1$ and $K_2$ are real, positive gains; and $e = \hat{i} - i$ and $\dot{e} = f - \hat{f}$.

5. The method of claim 1, wherein calculating the observed acceleration for the piston with the mechanical dynamic model comprises solving $$\ddot{\hat{x}} = \frac{1}{M}\left[\alpha I + A_p W \hat{\theta} - C\dot{x} - K(\bar{x} + \hat{x}_{TDC} - L_0)\right] + k_1 \dot{\tilde{x}} + \tilde{x} + k_2 r$$

where $\ddot{\hat{x}}$ is the observed acceleration,

M is a moving mass of the piston, $\alpha$ is a motor force constant,

I is a current to the motor, $A_p$ is a cross-sectional area of the piston,

W is a piecewise regressor derivative defined in the following table,

| Piecewise Condition | $W_1$ | $W_2$ |
|---|---|---|
| $\dot{x} < 0$, $\hat{P}(t) < \hat{P}_D$ | $\left(\frac{X_{BDC}}{x(t)}\right)^n - 1$ | 0 |
| $\dot{x} < 0$, $\hat{P}(t) \geq \hat{P}_D$ | −1 | 1 |
| $\dot{x} > 0$, $\hat{P}(t) > \hat{P}_D$ | −1 | $\left(\frac{X_{TDC}}{x(t)}\right)^n$ |
| $\dot{x} > 0$, $\hat{P}(t) \leq \hat{P}_D$ | 0 | 0 |

$\hat{\theta}$ is a matrix $[\hat{P}_S\ \hat{P}_D]^T$,
$\hat{P}_S$ is the estimated suction pressure,
$\hat{P}_D$ is the estimated discharge pressure,
$\hat{P}(t)$ is a chamber pressure, with $\hat{P}(t) \triangleq (W_1+1)\hat{P}_S + W_2\hat{P}_D$,
$\dot{x}$ is the first observed velocity,
$\bar{x}$ is the bounded integral of the first observed velocity,
$\hat{x}_{TDC}$ is the estimated clearance,
$x(t)$ is a sum of $\bar{x}$ and $\hat{x}_{TDC}$,
n is an adiabatic index,
$L_0$ is an equilibrium position of the piston,
C is a damping coefficient of the linear compressor, and
K is a spring stiffness of the linear compressor.

6. The method of claim 1, wherein calculating the observed acceleration for the piston with the mechanical dynamic model comprises solving $$\ddot{\hat{x}} = \frac{1}{M}\left[\alpha I + A_p\left(\int \dot{W}\hat{\theta} - \hat{P}_S\right) - C\dot{x} - K(\bar{x} + \hat{x}_{TDC} - L_0)\right] + k_1\dot{\tilde{x}} + \tilde{x} + k_2 r$$

where
$\ddot{\hat{x}}$ is the observed acceleration,
M is a moving mass of the piston,
$\alpha$ is a motor force constant,
I is a current to the motor,
$A_p$ is a cross-sectional area of the piston,
$\dot{W}$ is a piecewise regressor derivative defined in the following table,

| Piecewise Condition | $\dot{W}_1$ | $\dot{W}_2$ |
|---|---|---|
| $\dot{x} < 0$, $\hat{P}(t) < \hat{P}_D$ | $-n\left(\frac{X_{BDC}}{x(t)}\right)^n \frac{\dot{x}(t)}{x(t)}$ | 0 |
| $\dot{x} < 0$, $\hat{P}(t) \geq \hat{P}_D$ | 0 | 0 |
| $\dot{x} > 0$, $\hat{P}(t) > \hat{P}_S$ | 0 | $-n\left(\frac{X_{TDC}}{x(t)}\right)^n \frac{\dot{x}(t)}{x(t)}$ |
| $\dot{x} > 0$, $\hat{P}(t) \leq \hat{P}_S$ | 0 | 0 |

$\hat{\theta}$ is a matrix $[\hat{P}_S\ \hat{P}_D]^T$,
$\hat{P}_S$ is the estimated suction pressure,
$\hat{P}_D$ is the estimated discharge pressure,
$\hat{P}(t)$ is an observed chamber pressure,
$\dot{x}$ is the first observed velocity,
$\bar{x}$ is the bounded integral of the first observed velocity,
$\hat{x}_{TDC}$ is the estimated clearance,
$x(t)$ is a sum of $\bar{x}$ and $\hat{x}_{TDC}$,
n is an adiabatic index,
$L_0$ is an equilibrium position of the linear compressor,
C is a damping coefficient of the linear compressor,
K is a spring stiffness of the linear compressor,
$k_1$ and $k_2$ are observer gains,
$\dot{\tilde{x}}$ is the error between the first and second observed velocities,
$\tilde{x}$ is the error between the bounded integral of the first observed velocity and the observed position, and
r is a sum of $\dot{\tilde{x}}$ and a product of $k_1$ and $\tilde{x}$.

7. The method of claim 1, wherein updating the discharge pressure and the estimated suction pressure comprises integrating $$\dot{\hat{\theta}} = \frac{A_p}{M}\Gamma W^T r$$

where
$\dot{\hat{\theta}}$ is a derivative of the matrix $[\hat{P}_S\ \hat{P}_D]^T$,
$\hat{P}_S$ is the estimated suction pressure,
$\hat{P}_D$ is the estimated discharge pressure,
$A_p$ is a cross-sectional area of the piston,
M is a moving mass of the piston,
$\Gamma$ is a diagonal gain matrix,
r is a sum of $\dot{\tilde{x}}$ and a product of $k_1$ and $\tilde{x}$,
$\dot{\tilde{x}}$ is the error between the first and second observed velocities,
$\tilde{x}$ is the error between the bounded integral of the first observed velocity and the observed position, and
$k_1$ is an observer gain.

8. A method for operating a linear compressor, comprising:

step for calculating a first observed velocity for a piston of the linear compressor using at least an electrical dynamic model for a motor of the linear compressor and a robust integral of the sign of the error feedback;

substituting the first observed velocity, a bounded integral of the first observed velocity, an estimated clearance, an estimated discharge pressure, and an estimated suction pressure into a mechanical dynamic model for the motor;

step for calculating an observed acceleration for the piston with the mechanical dynamic model for the motor;

calculating a second observed velocity for the piston by integrating the observed acceleration for the piston;

calculating an observed position of the piston by integrating the second observed velocity for the piston;

determining an error between the first and second observed velocities and an error between the bounded integral of the first observed velocity and the observed position; and updating the estimated clearance, the estimated discharge pressure, and the estimated suction pressure based upon the error between the first and second observed velocities and the error between the bounded integral of the first observed velocity and the observed position.

9. The method of claim 8, wherein calculating the step for calculating the first observed velocity comprises:

estimating a back-EMF of the motor of the linear compressor using the electrical dynamic model for the motor of the linear compressor and the robust integral of the sign of the error feedback; and determining the first observed velocity of the motor of the linear compressor based at least in part on the back-EMF of the motor.

10. The method of claim 9, wherein the electrical dynamic model for the motor comprises $$\frac{di}{dt} = \frac{v_a}{L_i} - \frac{r_i i}{L_i} - \frac{\alpha \dot{x}}{L_i}$$

where $v_a$ is a voltage across the motor of the linear compressor;

$r_i$ is a resistance of the motor of the linear compressor;

i is a current through the motor of the linear compressor;

$\alpha$ is a motor force constant;

$\dot{x}$ is a velocity of the motor of the linear compressor; and $L_i$ is an inductance of the motor of the linear compressor.

11. The method of claim 10, wherein estimating the back-EMF of the motor of the linear compressor using the robust integral of the sign of the error feedback comprises solving $$\hat{f} = (K_1+1)e(t) + \int_{t_0}^{t}[(K_1+1)e(\sigma) + K_2 \operatorname{sgn}(e(\sigma))]d\sigma - (K_1+1)e(t_0)$$

where $\hat{f}$ is an estimated back-EMF of the motor of the linear compressor;

$K_1$ and $K_2$ are real, positive gains; and $e = \hat{i} - i$ and $\dot{e} = f - \hat{f}$.

12. The method of claim 8, wherein calculating the observed acceleration for the piston with the mechanical dynamic model comprises solving $$\ddot{\hat{x}} = \frac{1}{M}\left[\alpha I + A_p W \hat{\theta} - C\dot{x} - K(\bar{x} + \hat{x}_{TDC} - L_0)\right] + k_1 \dot{\tilde{x}} + \tilde{x} + k_2 r$$

where $\ddot{\hat{x}}$ is the observed acceleration,

M is a moving mass of the piston, $\alpha$ is a motor force constant,

I is a current to the motor, $A_p$ is a cross-sectional area of the piston, $\dot{W}$ is a piecewise regressor derivative defined in the following table,

| Piecewise Condition | $W_1$ | $W_2$ |
|---|---|---|
| $\dot{x} < 0$, $\hat{P}(t) < \hat{P}_D$ | $\left(\frac{X_{BDC}}{x(t)}\right)^n - 1$ | 0 |
| $\dot{x} < 0$, $\hat{P}(t) \geq \hat{P}_D$ | −1 | 1 |
| $\dot{x} > 0$, $\hat{P}(t) > \hat{P}_D$ | −1 | $\left(\frac{X_{TDC}}{x(t)}\right)^n$ |
| $\dot{x} > 0$, $\hat{P}(t) \leq \hat{P}_D$ | 0 | 0 |

$\hat{\theta}$ is a matrix $[\hat{P}_S\ \hat{P}_D]^T$, $\hat{P}_S$ is the estimated suction pressure, $\hat{P}_D$ is the estimated discharge pressure, $\hat{P}(t)$ is a chamber pressure, with $\hat{P}(t) \triangleq (W_1+1)\hat{P}_S + W_2 \hat{P}_D$, $\dot{x}$ is the first observed velocity, $\bar{x}$ is the bounded integral of the first observed velocity, $\hat{x}_{TDC}$ is the estimated clearance, x(t) is a sum of $\bar{x}$ and $\hat{x}_{TDC}$, n is an adiabatic index, $L_0$ is an equilibrium position of the piston, C is a damping coefficient of the linear compressor, and K is a spring stiffness of the linear compressor.

13. The method of claim 8, wherein the step for calculating the observed acceleration comprises solving $$\ddot{\hat{x}} = \frac{1}{M}\left[\alpha I + A_p\left(\int \dot{W}\hat{\theta} - \hat{P}_S\right) - C\dot{x} - K(\bar{x} + \hat{x}_{TDC} - L_0)\right] + k_1 \dot{\tilde{x}} + \tilde{x} + k_2 r$$

where $\ddot{\hat{x}}$ is the observed acceleration,

M is a moving mass of the piston, $\alpha$ is a motor force constant,

I is a current to the motor, $A_p$ is a cross-sectional area of the piston, $\dot{W}$ is a piecewise regressor derivative defined in the following table,

| Piecewise Condition | $\dot{W}_1$ | $\dot{W}_2$ |
|---|---|---|
| $\dot{x} < 0$, $\hat{P}(t) < \hat{P}_D$ | $-n\left(\frac{X_{BDC}}{x(t)}\right)^n \frac{\dot{x}(t)}{x(t)}$ | 0 |
| $\dot{x} < 0$, $\hat{P}(t) \geq \hat{P}_D$ | 0 | 0 |
| $\dot{x} > 0$, $\hat{P}(t) > \hat{P}_S$ | 0 | $-n\left(\frac{X_{TDC}}{x(t)}\right)^n \frac{\dot{x}(t)}{x(t)}$ |
| $\dot{x} > 0$, $\hat{P}(t) \leq \hat{P}_S$ | 0 | 0 |

$\hat{\theta}$ is a matrix $[\hat{P}_S\ \hat{P}_D]^T$, $\hat{P}_S$ is the estimated suction pressure, $\hat{P}_D$ is the estimated discharge pressure, $\hat{P}(t)$ is a chamber pressure, $\dot{x}$ is the first observed velocity, $\bar{x}$ is the bounded integral of the first observed velocity, $\hat{x}_{TDC}$ is the estimated clearance, x(t) is a sum of $\bar{x}$ and $\bar{x}_{TDC}$, n is an adiabatic index, $L_0$ is an equilibrium position of the linear compressor, C is a damping coefficient of the linear compressor, K is a spring stiffness of the linear compressor, $k_1$ and $k_2$ are observer gains, $\dot{\tilde{x}}$ is the error between the first and second observed velocities, $\tilde{x}$ is the error between the bounded integral of the first observed velocity and the observed position, and r is a sum of $\dot{\tilde{x}}$ and a product of $k_1$ and $\tilde{x}$.

14. The method of claim 8, wherein updating the discharge pressure and the estimated suction pressure comprises integrating $$\dot{\hat{\theta}} = \frac{A_p}{M}\Gamma W^T r$$

where $\dot{\hat{\theta}}$ is a derivative of the matrix $[\hat{P}_S\ \hat{P}_D]^T$, $\hat{P}_S$ is the estimated suction pressure, $\hat{P}_D$ is the estimated discharge pressure, $A_p$ is a cross-sectional area of the piston, M is a moving mass of the piston, Γ is a diagonal gain matrix, r is a sum of $\dot{\tilde{x}}$ and a product of $k_1$ and $\tilde{x}$, $\dot{\tilde{x}}$ is the error between the first and second observed velocities, $\tilde{x}$ is the error between the bounded integral of the first observed velocity and the observed position, and $k_1$ is an observer gain.

15. The method of claim 8, further comprising adjusting operation of the linear compressor based upon the updated estimated clearance, the updated estimated discharge pressure, and the updated estimated suction pressure.

16. A method for operating a linear compressor, comprising:

step for calculating a first observed velocity for a piston of the linear compressor using at least an electrical dynamic model for a motor of the linear compressor and a robust integral of the sign of the error feedback;

substituting the first observed velocity, a bounded integral of the first observed velocity, an estimated clearance, an estimated discharge pressure, and an estimated suction pressure into the mechanical dynamic model for the motor;

step for calculating an observed acceleration for the piston with the mechanical dynamic model for the motor;

step for calculating a second observed velocity for the piston;

step for calculating an observed position of the piston;

step for determining an error between the first and second observed velocities and an error between the bounded integral of the first observed velocity and the observed position; and step for updating the estimated clearance, the estimated discharge pressure, and the estimated suction pressure based upon the error between the first and second observed velocities and the error between the bounded integral of the first observed velocity and the observed position.

* * * * *